US008476544B2

(12) United States Patent
Yan et al.

(10) Patent No.: US 8,476,544 B2
(45) Date of Patent: Jul. 2, 2013

(54) DEVICE FOR ADJUSTING ELECTRIC PARAMETERS

(75) Inventors: Yuejun Yan, Shenzhen (CN); Yuepeng Yan, Shenzhen (CN)

(73) Assignee: Yantel Corporation, Shenzhen (CN)

( * ) Notice: Subject to any disclaimer, the term of this patent is extended or adjusted under 35 U.S.C. 154(b) by 285 days.

(21) Appl. No.: 13/013,806

(22) Filed: Jan. 25, 2011

(65) Prior Publication Data

US 2011/0114466 A1 May 19, 2011

Related U.S. Application Data

(63) Continuation of application No. PCT/CN2009/072783, filed on Jul. 16, 2009.

(30) Foreign Application Priority Data

Jul. 28, 2008 (CN) ..... 2008 1 0144258

(51) Int. Cl.
*H01H 19/14* (2006.01)

(52) U.S. Cl.
USPC ..... 200/564; 200/11 R; 200/336

(58) Field of Classification Search
USPC ..... 200/564
See application file for complete search history.

(56) References Cited

U.S. PATENT DOCUMENTS 6,506,984 B2 * 1/2003 Tomita ..... 200/11 R
7,550,687 B2 * 6/2009 Su ..... 200/11 R

* cited by examiner

*Primary Examiner* — Renee S Luebke
*Assistant Examiner* — Lheiren Mae Caroc
(74) *Attorney, Agent, or Firm* — Matthias Scholl P.C.; Matthias Scholl

(57) ABSTRACT

A device for adjusting an electric parameter, including at least a base having at least two terminal pairs, a positioning body, and at least one first portion. Both ends of at least one of the terminal pair are connected to the first portion. A pair of signal terminals is disposed on the positioning body, and both ends of one of the terminal pairs are contacted with the signal terminal on the positioning body as a position of the base is changed, whereby facilitating adjustment of electric parameters. The device of the invention can be applied to various electronic circuits, RF circuits, microwave circuits, and so on, thus implementing step and quantitative adjustment of the electric parameters.

20 Claims, 16 Drawing Sheets

DEVICE FOR ADJUSTING ELECTRIC PARAMETERS

CROSS-REFERENCE TO RELATED APPLICATIONS

This application is a continuation of International Patent Application No. PCT/CN2009/072783 with an international filing date of Jul. 16, 2009, designating the United States, now pending, and further claims priority benefits to Chinese Patent Application No. 200810144258.3 filed on Jul. 28, 2008. The contents of all of the aforementioned applications, including any intervening amendments thereto, are incorporated herein by reference.

BACKGROUND OF THE INVENTION

1. Field of the Invention

The invention relates to an electronic device, and more particularly to a device for adjusting an electric parameter.

2. Description of the Related Art

Nowadays, different devices for adjusting electric parameters in electronic circuits are used. However, there are several problems with conventional devices for adjusting electric parameters: since size of a signal input end cannot be adjusted, the length of a signal path is increased, which leads to high insert loss, and affects electric performance of the circuit; adjustment of the device is inconvenient; and production cost thereof is high.

SUMMARY OF THE INVENTION

In view of the above-described problem, it is one objective of the invention to provide a device for adjusting an electric parameter that is capable of reducing size and thus insert loss of a circuit to be adjusted, and improving electric performance of the circuit, and features convenient adjustment, and low production cost.

To achieve the above objectives, in accordance with one embodiment of the invention, provided is a device for adjusting an electric parameter, comprising a base having at least two terminal pairs, a positioning body, and at least one first portion, both ends of at least one of the terminal pair are connected to the first portion, a pair of signal terminals are disposed on the positioning body, and both ends of one of the terminal pairs are contacted with the signal terminals on the positioning body as a position of the base is changed.

In a class of this embodiment, it further comprises a shifting body operating to rotate or to move the base whereby changing a position of the terminal pair on the base.

In a class of this embodiment, it further comprises a fastening device operating to tightly contacting the base with the positioning body.

In a class of this embodiment, the fastening device comprises an elastic body, a housing, and a fastening portion, the fastening portion operates to fix the positioning body to the housing, and the elastic body is disposed on the shifting body, and between the shifting body and the housing.

In a class of this embodiment, the elastic body is an elastic piece, a spring, or silica gel.

In a class of this embodiment, the signal terminals on the positioning body extend to the bottom or the outside of the positioning body.

In a class of this embodiment, the base is a PCB board, a ceramic substrate, or a resin base.

In a class of this embodiment, the base is a single-layered substrate, a double-layered substrate, or a multi-layered substrate.

In a class of this embodiment, the first portion is an inductor, a capacitor, or a resistor, and the first portion is disposed on different layers or the same layer of the base.

In a class of this embodiment, one of the terminal pairs is short connected.

In accordance with another embodiment of the invention, provided is a device for adjusting an electric parameter, comprising a base having at least two terminal pairs, and a common ground terminal, a positioning body having a ground terminal, and at least one second portion, both ends of at least one of the terminal pair are connected to the second portion, a pair of signal terminals and the ground terminal are disposed on the positioning body, a ground terminal of the second portion on the base is connected to the common ground terminal, the common ground terminal of the base is contacted with the ground terminal of the positioning body, and both ends of one of the terminal pairs are contacted with the signal terminals on the positioning body as a position of the base is changed.

In a class of this embodiment, it further comprises a shifting body operating to rotate or to move the base whereby changing a position of the terminal pair on the base.

In a class of this embodiment, it further comprises a fastening device operating to tightly contacting the base with the positioning body.

In a class of this embodiment, the fastening device comprises an elastic body, a housing, and a fastening portion, the fastening portion operates to fix the positioning body to the housing, and the elastic body is disposed on the shifting body, and between the shifting body and the housing.

In a class of this embodiment, the elastic body is an elastic piece, a spring, or silica gel.

In a class of this embodiment, the signal terminals on the positioning body extend to the bottom or the outside of the positioning body.

In a class of this embodiment, the base is a PCB board, a ceramic substrate, or a resin base.

In a class of this embodiment, the base is a single-layered substrate, a double-layered substrate, or a multi-layered substrate.

In a class of this embodiment, the second portion is an attenuator, a filter, or an impedance transformer, the second portion is disposed on different layers or the same layer of the base, and the second portion is disposed on the base via a thick-film process, or a thin-film process.

In a class of this embodiment, one of the terminal pairs is short connected.

Advantages of the invention comprise 1. the invention is capable of reducing size and thus insert loss of a circuit to be adjusted, and reducing affect of transmission distance on loss of a signal and on electric performance of the circuit, and features good RF performance.

2. the invention features convenient adjustment, and is applicable for adjustment of capacitors, inductors, resistors (loads), attenuators, and filters.

3. the invention features low production cost.

BRIEF DESCRIPTION OF THE DRAWINGS

FIG. 1(*b*) is a schematic view of a bottom layer of a base of a device for adjusting an electric parameter of an exemplary embodiment of the invention;

DETAILED DESCRIPTION OF THE EMBODIMENTS

Further description will be given below in conjunction with accompanying drawings and specific embodiments.

Figure 1A:
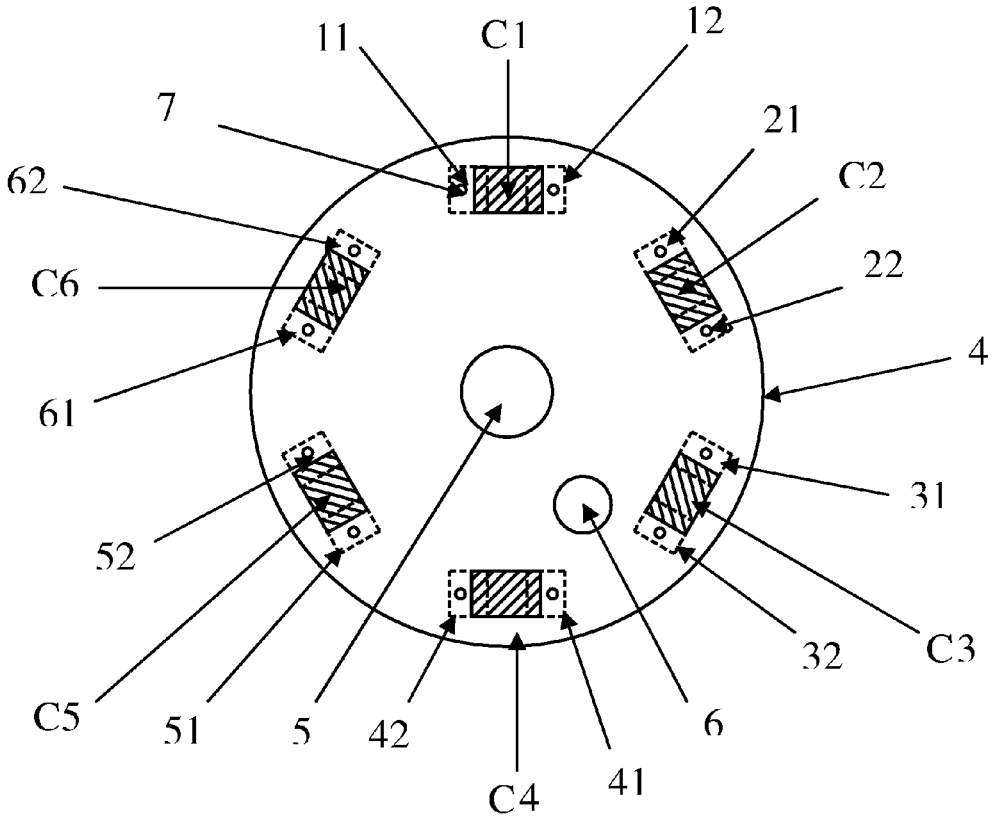
FIG. 1(*a*) is a schematic view of a surface layer of a base of a device for adjusting an electric parameter of an exemplary embodiment of the invention.
Figure 1B:
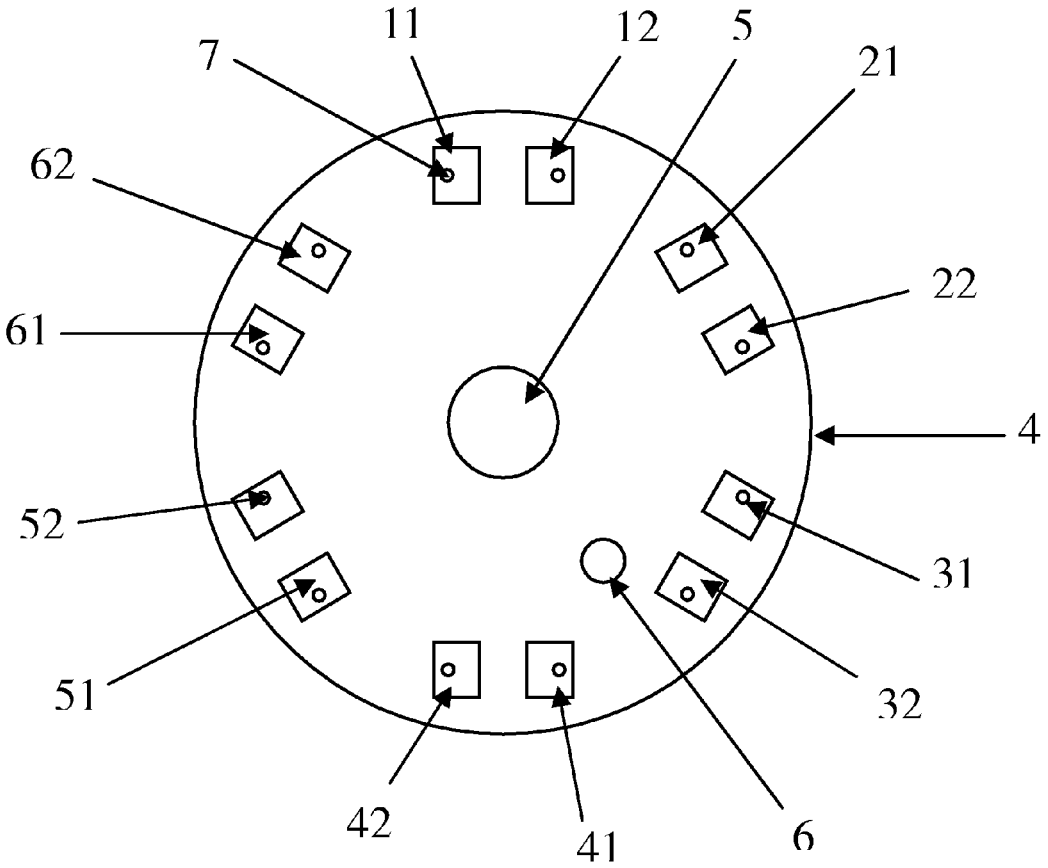

As shown in FIG. 1(*a*), a surface layer of a base of a device for adjusting an electric parameter of a first embodiment of the invention is illustrated. A base 4 is a PCB substrate or a ceramic substrate, and can be a single-layered, double-layered, or multi-layered substrate. In this embodiment, the base 4 is a double-layered circular (or polygonal) PCB substrate. At least two terminal pairs are disposed on a surface layer of the base 4. In this embodiment, six terminal pairs are used: 11 and 12, 21 and 22, 31 and 32, 41 and 42, 51 and 52, and 61 and 62. Both ends of each of the terminal pairs are connected to multiple first portions C1, C2, C3, C4, C5 and C6. In this embodiment, the first portions can be inductors, capacitors, resistors, or other electronic components, and may use different electric parameters. For devices for adjusting electric parameters with the same electric parameter, the first portions therein can be different types of electronic components, for example, one uses an inductor, and the other one uses a capacitor. If the first portion uses a chip inductor with different inductance, then the device becomes an adjustable inductor.

The first portion is a chip component, a component printed on the base 4, or a component produced on the base 4 via printing, sintering, sputtering, or insertion, and can be produced on different layers of the base 4. As shown in FIG. 1(*b*), each terminal pair is connected to the bottom layer of the base 4 via a respective signal through hole 7. A positioning hole 5 and a shifting hole 6 are disposed on the base 4, and operate with a shifting body whereby enabling the base 4 to rotate with respect to the positioning body 3.

The first portion can be disposed on different layers or the same layer of the base 4, or on the same layer as the terminal pair.

Figure 2:
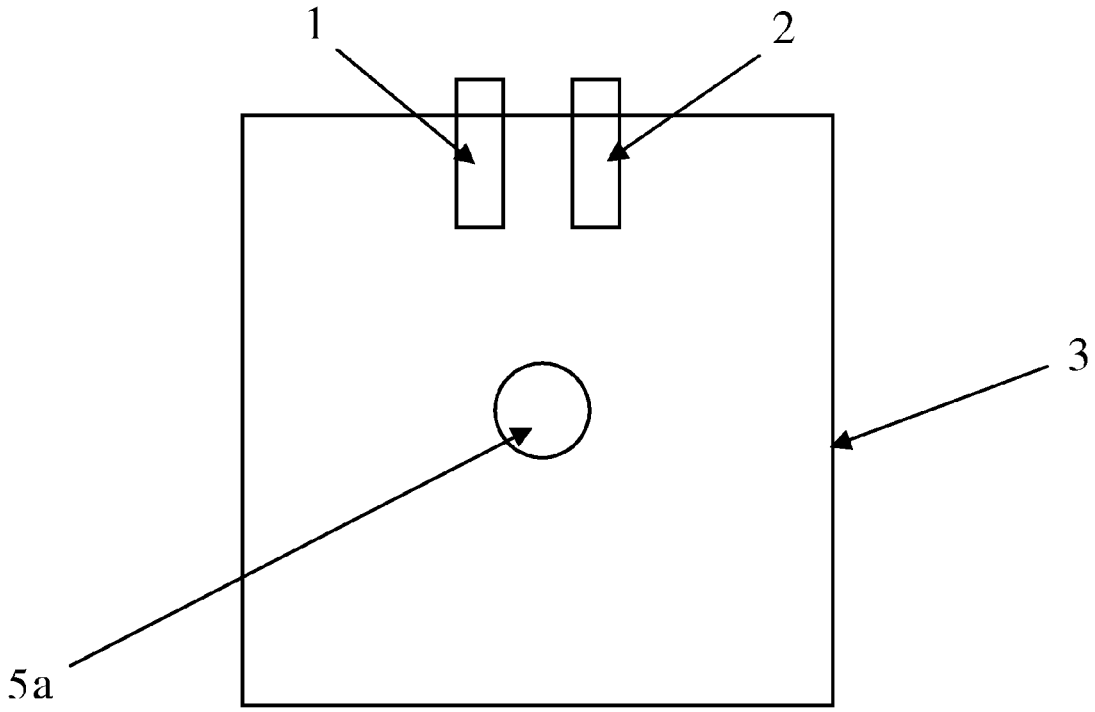
FIG. 2 is a schematic view of a positioning body of a device for adjusting an electric parameter of the invention.

As shown in FIG. 2, a positioning body of a device for adjusting an electric parameter of a first embodiment of the invention is illustrated. The positioning body 3 is a PCB board, a pair of signal terminals 1 and 2 are disposed on the surface thereof, and operate as a signal terminals (signal input terminal and a signal output terminal) for the device.

A metal piece is connected to each of the signal terminals 1 and 2. The signal terminals 1 and 2 extend to the outside of the positioning body 3, and operate as signal terminals.

The positioning body 3 is a double-layered PCB board, the signal terminals 1 and 2 are led to the bottom layer of the double-layered PCB board via the signal through hole 7, and operate as signal terminals of the device (namely a signal input terminal and a signal output terminal).

The positioning body 3 is a ceramic substrate, a resin base, or other types of substrate. A positioning hole 5*a* is disposed on the positioning body 3.

Figure 3:
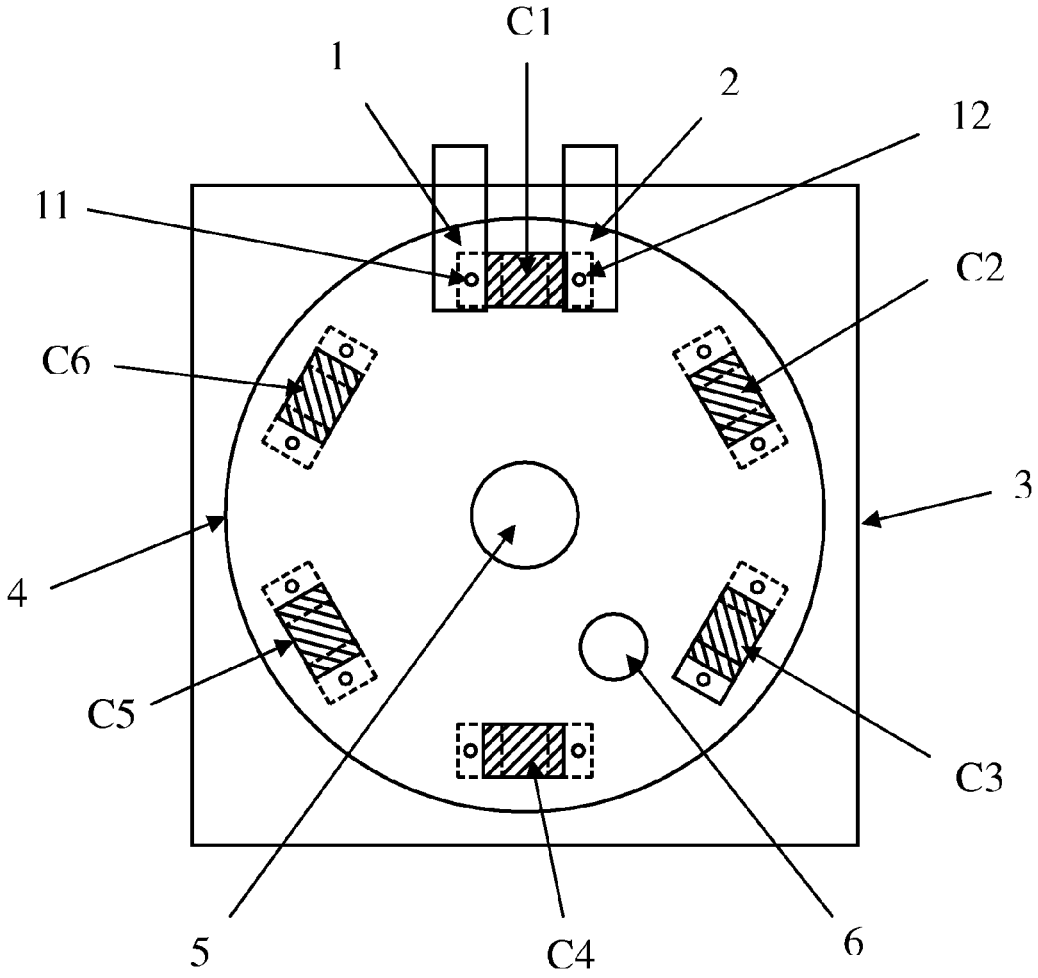
FIG. 3 illustrates a combination of a positioning body with a base of a device for adjusting an electric parameter of the invention.

As shown in FIG. 3, a combination of a positioning body with a base of a device for adjusting an electric parameter of a first embodiment of the invention is illustrated.

A surface layer of the positioning body 3 is contacted with a bottom layer of the base 4. The positioning hole 5*a* on the positioning body 3 is overlapped with the positioning hole 5 on the base 4. The terminal pair 11 and 12 is respectively connected to the signal terminals 1 and 2 on the positioning body 3. As the base 4 rotates, the next terminal pair is sequentially connected to the signal terminals 1 and 2 on the positioning body 3. For example, the terminal pair 21 and 22 is respectively connected to the signal terminals 1 and 2. Thus, connection between six first portions C1, C2, C3, C4, C5 and C6 and the signal terminals 1 and 2 is implemented. As first portions with different electric parameters are used, adjustment of electric parameters is facilitated. It should be noted that, movement of the base 4 with respect to the positioning body 3 is not limited to rotation, and pushing can also be used to implement this. By changing input electric parameters between the signal terminals 1 and 2, adjustment of the electric parameters is facilitated.

Figure 4:
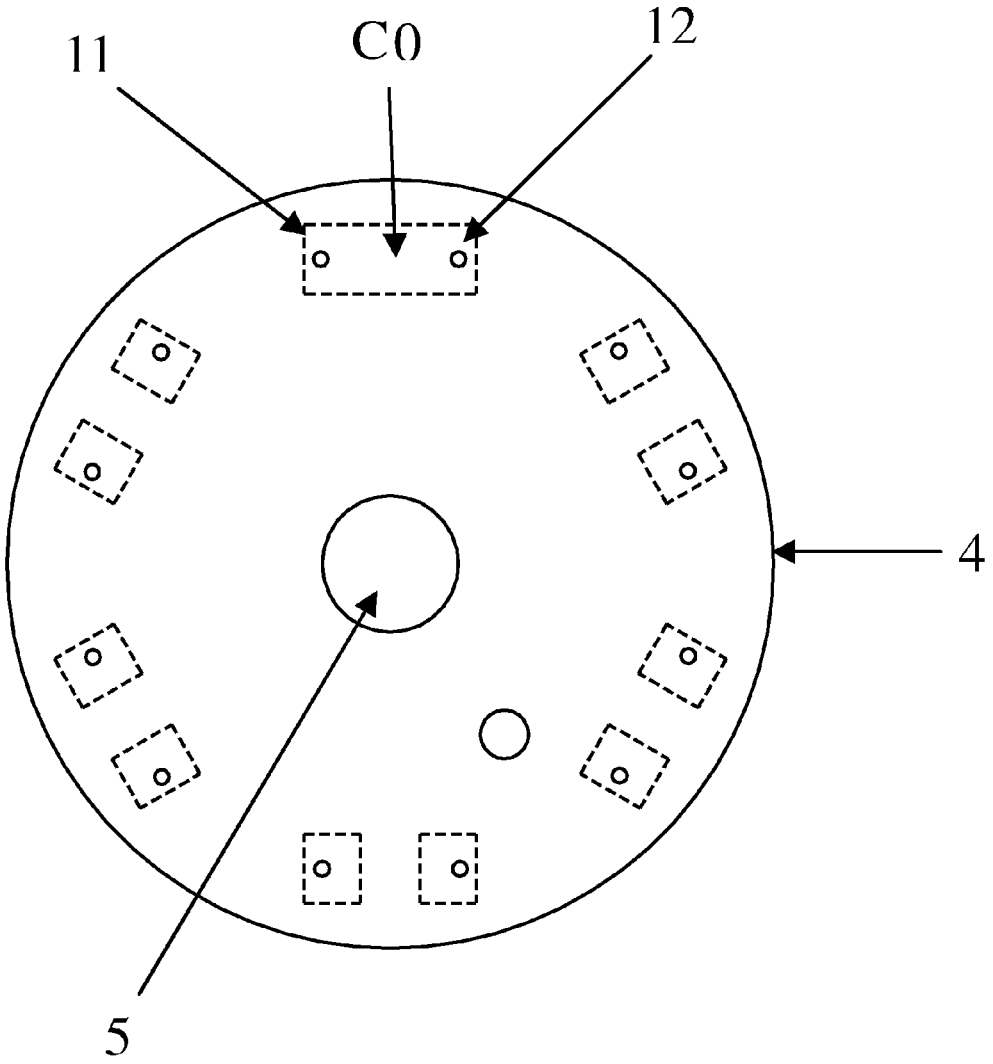
FIG. 4 is a schematic view of a bottom layer of a base with a return-to-zero terminal pair of a device for adjusting an electric parameter of the invention.

As shown in FIG. 4, a bottom layer of a base with a return-to-zero terminal pair of a device for adjusting an electric parameter of a first embodiment of the invention is illustrated.

Another terminal pair 11 and 12 at the bottom layer of the base 4 is short connected via a signal microstrip line C0. As the terminal pair 11 and 12 is connected to the signal terminals 1 and 2 on the positioning body 3, the signal terminals 1 and 2 are short connected, namely in a return-to-zero state. When selecting the different length of the signal microstrip line, the first portion is a phase shifter.

Figure 5:
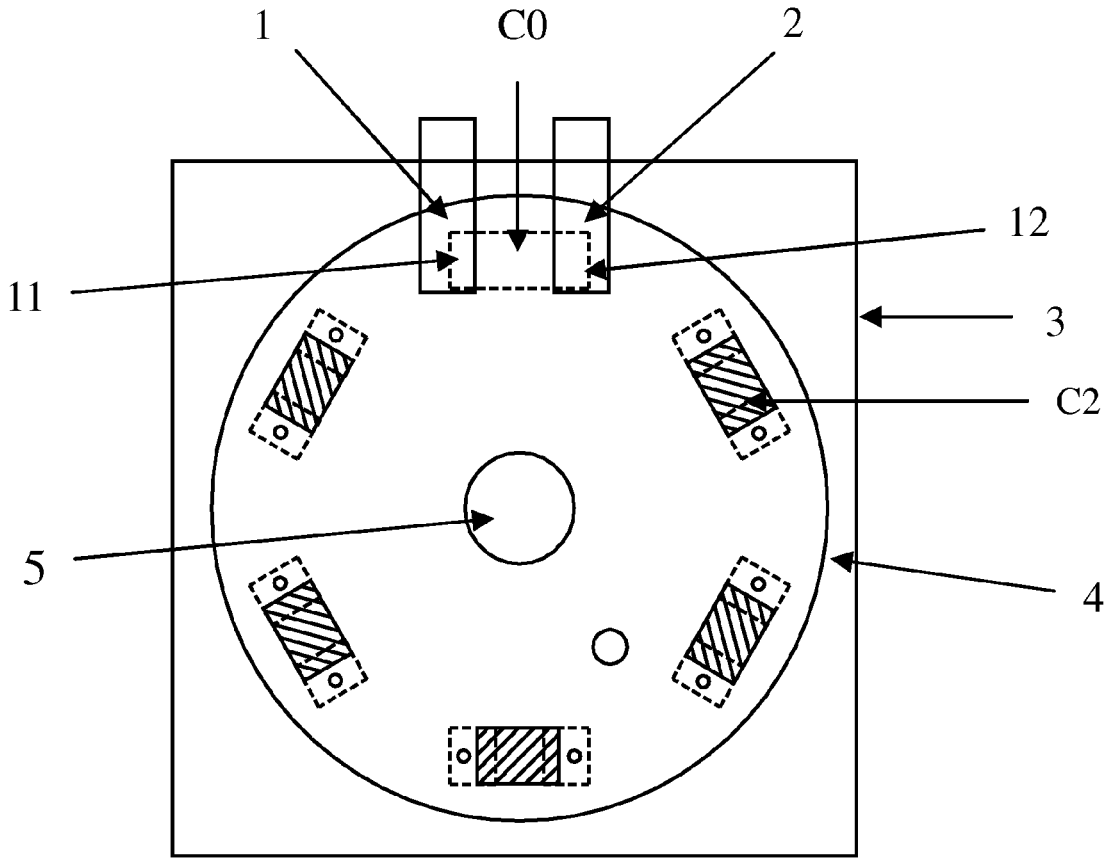
FIG. 5 illustrates a combination of a positioning body with a base as a device for adjusting an electric parameter is in a return-to-zero state.

FIG. 5 illustrates a combination of a positioning body 3 with a base 4 as a device for adjusting an electric parameter is in a return-to-zero state.

Figure 6:
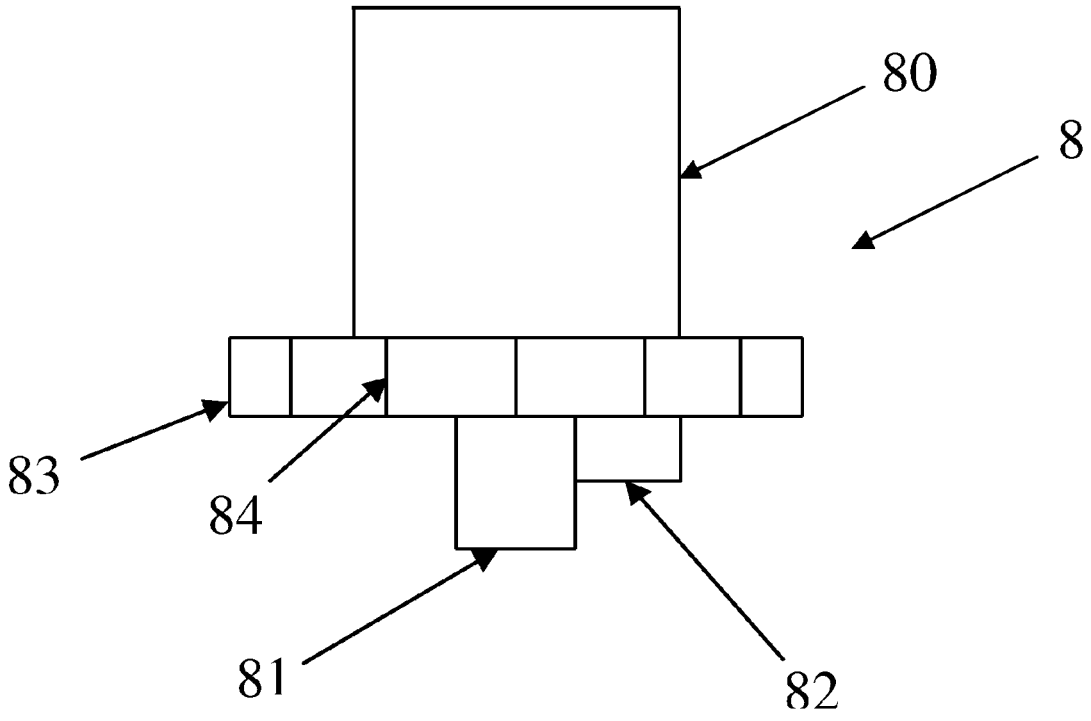
FIG. 6 is a schematic view of a shifting body of the invention.

As shown in FIG. 6, a shifting body of a device for adjusting an electric parameter of a first embodiment of the invention is illustrated. A main part of the shifting body 8 is a cylinder 80, a positioning cylinder 81 and a shifting cylinder 82 are disposed at the bottom thereof. The positioning cylinder 81 passes through the positioning hole 5 of the base 4 and is received in the positioning hole 5*a* of the positioning body 3 whereby facilitating positioning. The shifting cylinder 82 is received in the positioning hole 6 of the base 4, but does not pass through the positioning hole 6, whereby driving the base 4 to rotate (shift). The shifting body 8 further comprises a pressure spanner 83 disposed outside the bottom of the cylinder 80. The cylinder 80 and the pressure spanner 83 are integrally or separately formed.

A positioning tooth 84 is disposed on one side of the pressure spanner 83, and operates to ensure each terminal pair on the base 4 is accurately connected to the signal terminals 1 and 2 on the positioning body 3.

Figure 7:
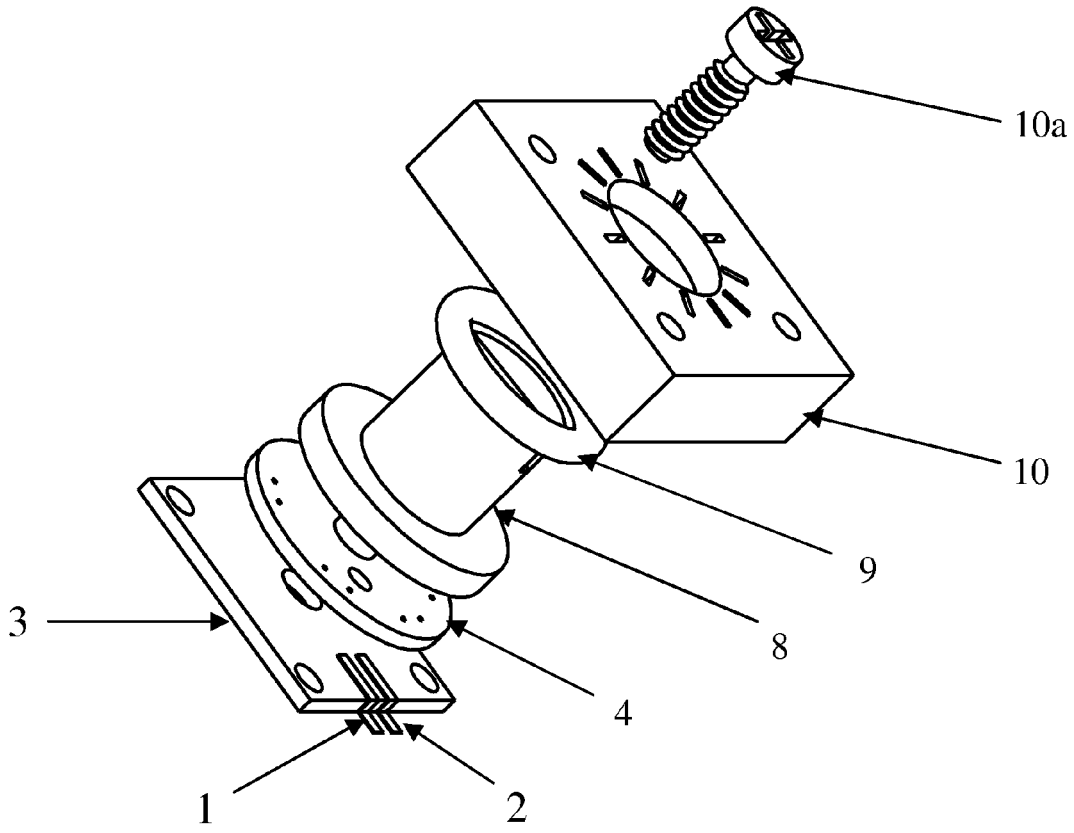
FIG. 7 is a schematic view of a device for adjusting an electric parameter of an exemplary embodiment of the invention.

As shown in FIG. 7, a device for adjusting an electric parameter of a first embodiment of the invention is illustrated. The base 4 is disposed on the positioning body 3. The bottom layer of the base 4 is contacted with the surface layer of the positioning body 3. The shifting body 8 is disposed on the base 4. An elastic body 9 is disposed on the shifting body 8, and between the pressure spanner 83 and a housing 10. An inner surface layer of the housing 10 is disposed on the elastic body 9. In this embodiment, the housing 10 is a resin housing, a metal housing, and so on.

The elastic body 9 is a silicon gel ring, a metal spring, or an elastic piece, and operates to tightly contact the base 4 with the positioning body 3 when fixing the positioning body 3 and the housing 10 via a screw 10*a* whereby tightly pressing the positioning body 3, the base 4, the shifting body 8, and the housing 10. The elastic body 9, the housing 10, and the screw 10*a* form a fastening device. It should be noted that other fastening components, such as bolts, buckles, and clamps, can also be used to fix the positioning body 3 and the housing 10. In addition, a fastening screw 10*a* disposed outside the housing 10 is used to fix the device for adjusting an electric parameter on an external circuit board.

It should be noted that, the base 4 and the shifting body 8 can be integrally formed whereby facilitating adjustment of electric parameters.

Figure 8:
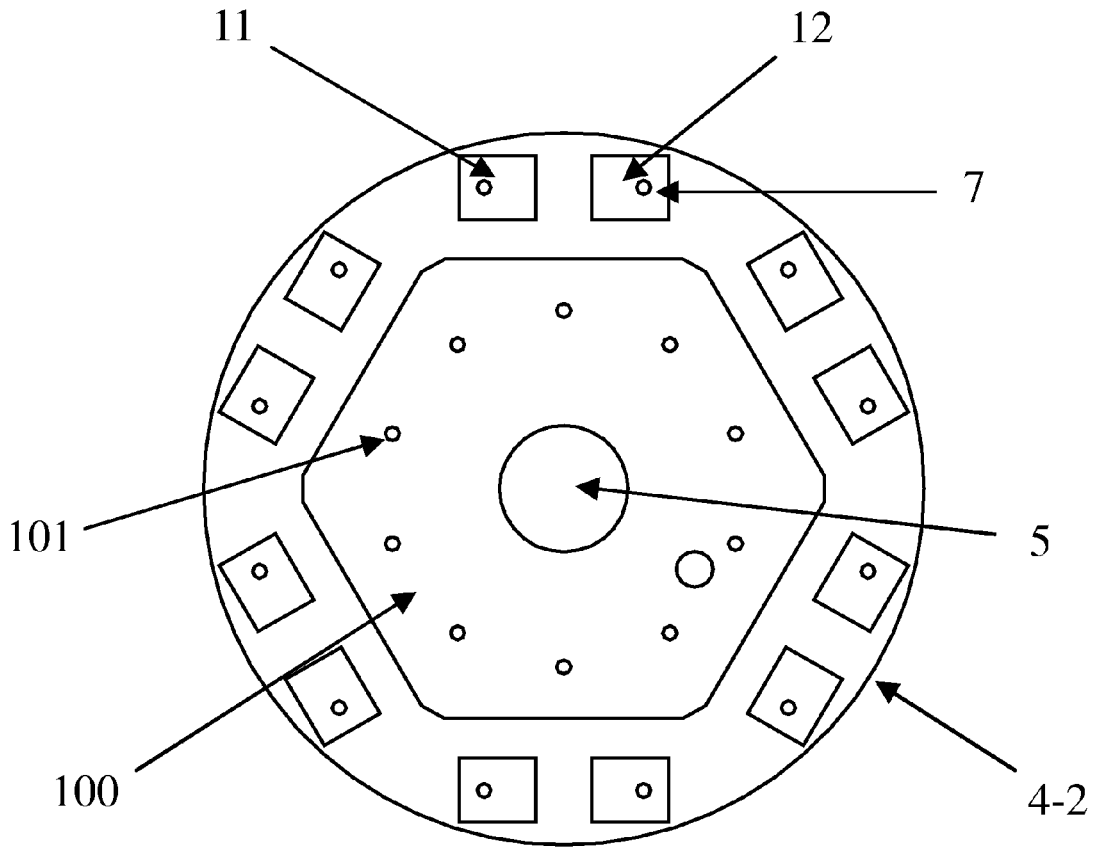
FIG. 8 is a schematic view of a bottom layer of a base of a device for adjusting an electric parameter of another exemplary embodiment of the invention.

As shown in FIG. 8, a bottom layer of a base of a device for adjusting an electric parameter of a second embodiment of the invention is illustrated. A base 4-2 is a double-layered PCB substrate. The base 4-2 can be ceramic substrate or other materials. Difference between a bottom layer of the base 4-2 and that in the first embodiment in FIG. 1(*b*) is that a common ground terminal 100 and a through hole 101 are added. The common ground terminal 100 passes through the through hole 101, and is connected to another common ground terminal 100 on a surface layer of the base 4-2. At least two terminal pairs are used: 11 and 12, 21 and 22, 31 and 32, 41 and 42, 51 and 52, and 61 and 62. Each terminal pair is connected to an terminal pair on a surface layer of the base 4-2 via a respective signal through hole 7.

Figure 9:
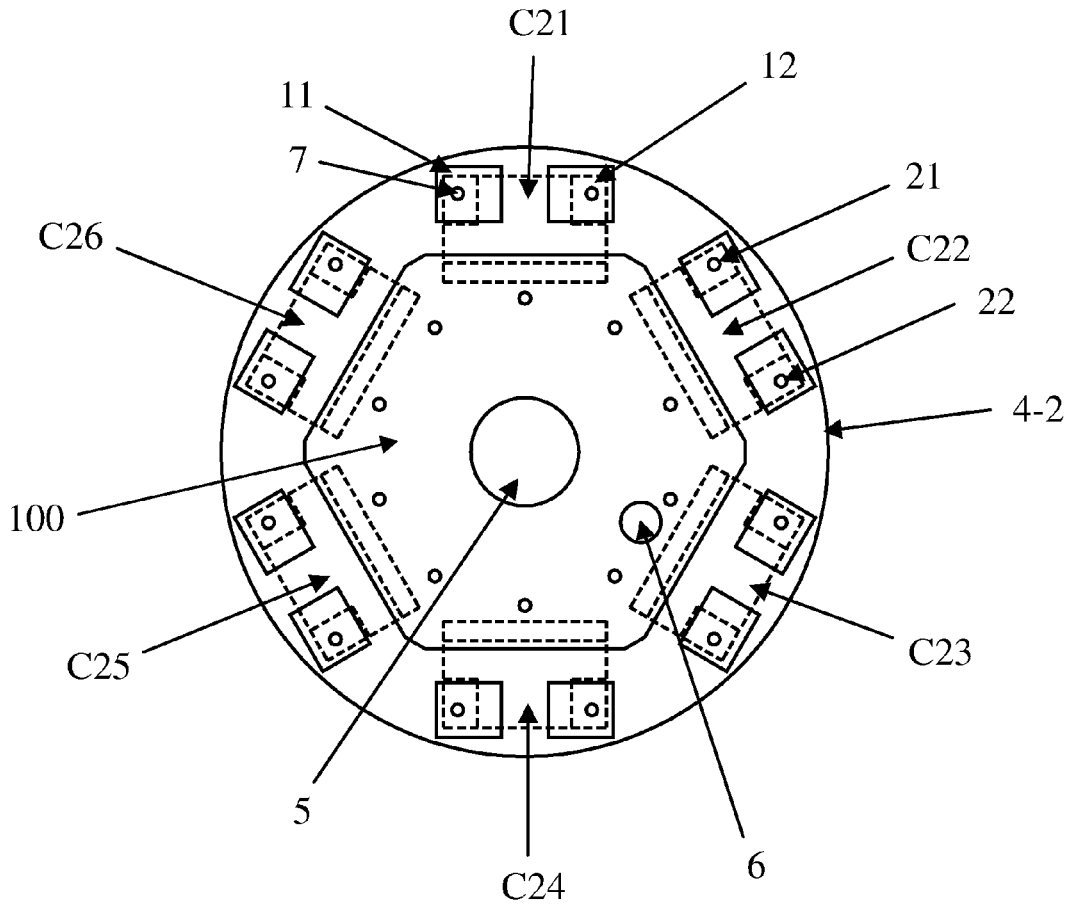
FIG. 9 is a schematic view of a surface layer of a base of a device for adjusting an electric parameter of another exemplary embodiment of the invention.

As shown in FIG. 9, a surface layer of a base of a device for adjusting an electric parameter of a second embodiment of the invention is illustrated. Six terminal pairs are disposed on a surface layer of the base 4-2 corresponding to the bottom layer. Six second portions C21, C22, C23, C24, C25, and C26 are disposed on the surface layer of the base 4-2, and have different electric parameters. Difference between the second portion and the first portion is, the second portion comprises two signal terminals and one ground terminal. The two signal terminals are connected to the terminal pair on the base 4-2, and the ground terminal of the second portion is connected to the common ground terminal on the base 4-2. For example, the two signal terminals of the second portion C21 are connected to the terminal pair 11 and 12, and those of the second portion C22 are connected to the terminal pair 21 and 22, and thus connection with six second portions is sequentially implemented. A positioning hole 5, a shifting hole 6, and a signal through hole 7 are disposed on the base 4-2. The signal through hole 7 operates to connect the terminal pair of the second pair on the surface layer of the base 4-2 to a corresponding terminal pair on the bottom layer thereof.

In this embodiment, the second portion is an attenuator, a filter, an impedance transformer, an isolator or other electronic components. For an asymmetric component such as a filter, the signal terminals (input/output terminals) the filter are connected to the terminals (input/output terminals) of the signal terminals of the base 4-2.

In this embodiment, the second portion is a combined component, a separated component, or a combination thereof.

Figure 10:
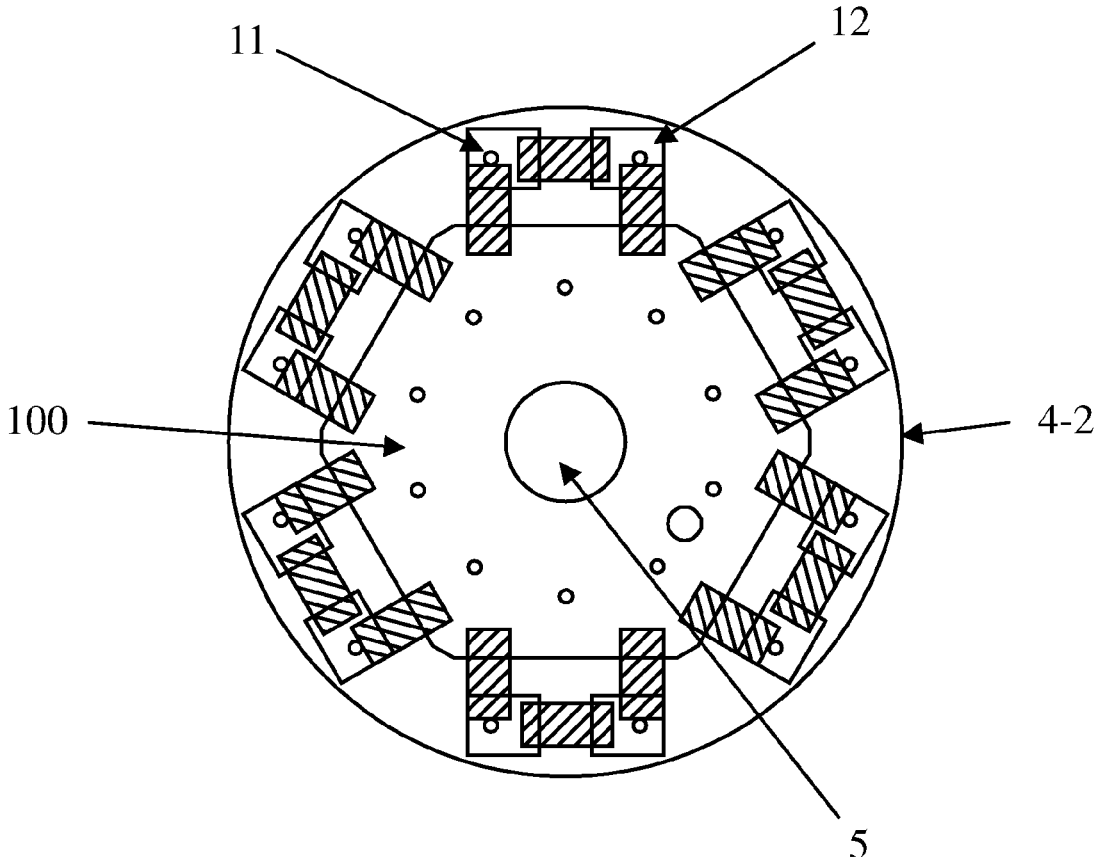
FIG. 10 is a schematic view of a second portion implemented via separated components.

As shown in FIG. 10, a second portion implemented via separated components is illustrated. The second portion is a Pi-type attenuator comprising three resistors. Attenuation of the six Pi-type attenuators is different whereby implementing adjustment of attenuation. The second portion is disposed on different layers or the same layer of the base 4-2, or on the same layer as the terminal pair.

Figure 11:
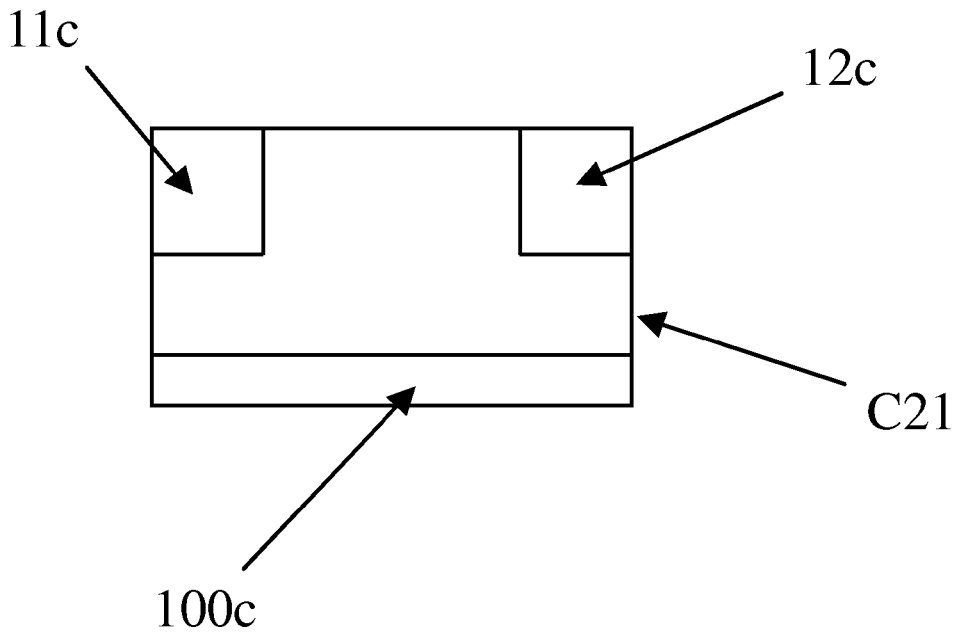
FIG. 11 is a schematic view of a second portion implemented via combined components.

As shown in FIG. 11, the second portion is a combined chip component, a chip component made of a thick-film circuit or a thin-film circuit, or integrated component (module), and so on.

Figure 12:
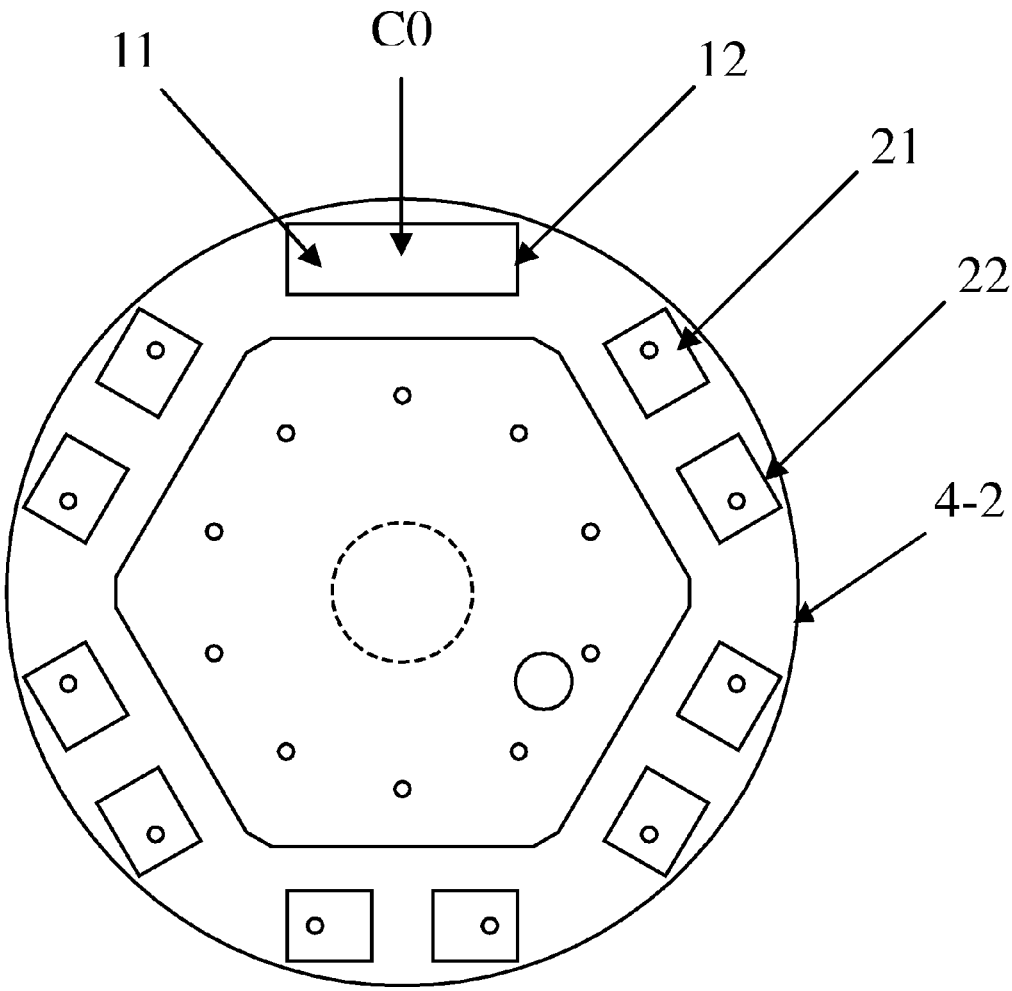
FIG. 12 is a schematic view of a bottom layer of a base with a return-to-zero terminal pair of a device for adjusting an electric parameter of another exemplary embodiment of the invention.

Signal terminals 11*c* and 12*c* of the second portion C21 are respectively connected to the terminal pair 11 and 12, and the ground terminal 100*c* is connected to the common ground terminal 100 on the surface layer of the base 4-2. In addition, the second portion can be produced on the base 4-2 via a thick-film process such as printing or sintering, a thin-film process such as sputtering, or insertion, As shown in FIG. 12, a bottom layer of a base with a return-to-zero terminal pair of a device for adjusting an electric parameter of a second embodiment of the invention is illustrated. An terminal pair of the base 4-2 may be not connected to the second portion. Another terminal pair 11 and 12 at the bottom layer of the base 4-2 is short connected via a signal microstrip line C0. As the terminal pair 11 and 12 is connected to the signal terminals 1 and 2 on the positioning body, the signal terminals 1 and 2 are short connected, namely in a return-to-zero state.

To prevent interruption (total reflection) occurs on a signal loop during switching between different second portions (such as the attenuator and so on), the terminals can be made into a cross terminals. For example, as the shifting body 8 rotates in a counterclockwise direction, the next terminal 21 is contacted with the signal terminal 1 before the terminal 11 is detached from the signal terminal 1, and the next terminal 22 is contacted with the signal terminal 2 before the terminal 12 is detached from the signal terminal 2, which prevents sudden signal interruption, and total reflection of a signal.

Figure 13:
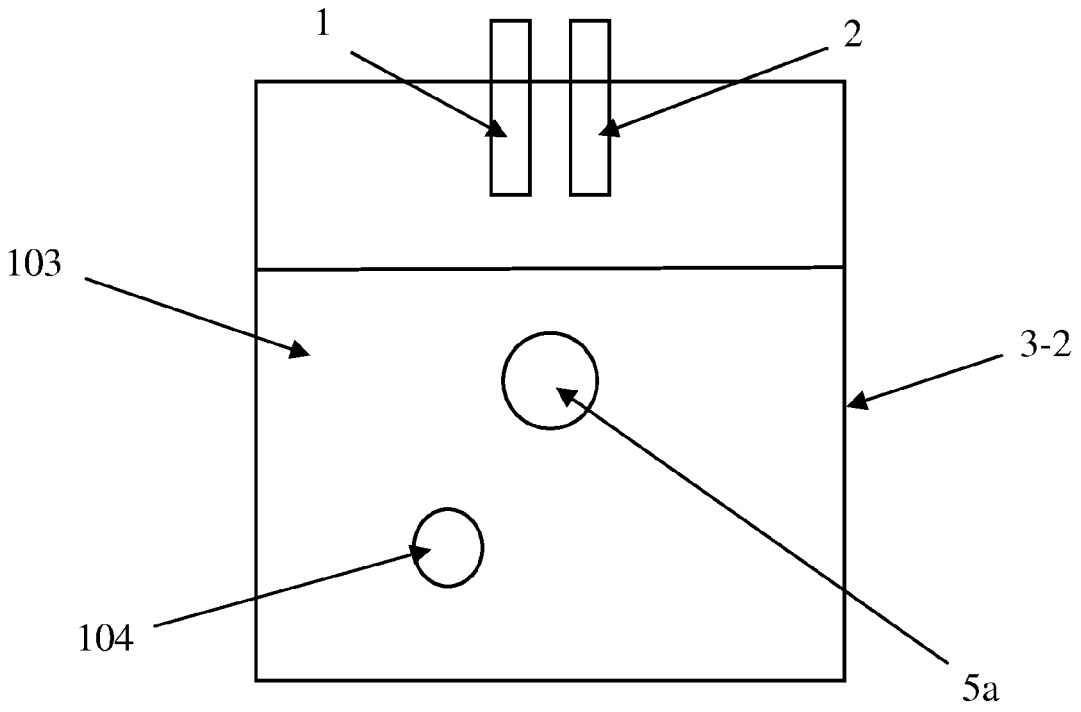
FIG. 13 is a schematic view of a positioning body of a device for adjusting an electric parameter of another exemplary embodiment of the invention.

As shown in FIG. 13, a positioning body of a device for adjusting an electric parameter of a second embodiment of the invention is illustrated.

The positioning body 3-2 is a PCB board, a pair of signal terminals 1 and 2 are disposed on the surface thereof.

A metal piece is connected to each of the signal terminals 1 and 2. The signal terminals 1 and 2 extend to the outside of the positioning body 3-2, and operate as signal terminals (signal input/output terminals).

The positioning body 3-2 is a double-layered PCB board, the signal terminals 1 and 2 are led to the bottom layer of the double-layered PCB board via the signal through hole 7, and operate as terminals of the signal terminals 1 and 2 connected to an external signal line.

A ground terminals 103 are disposed on a surface layer of the positioning body 3-2 and on a bottom layer thereof, and connected to each other via a through hole 104. The ground terminal 103 can be connected to the outside of the positioning body 3-2 via the metal piece.

The positioning body 3-2 can be a ceramic substrate, or other types of substrate. A positioning hole 5*a* is disposed on the positioning body 3-2.

Figure 14:
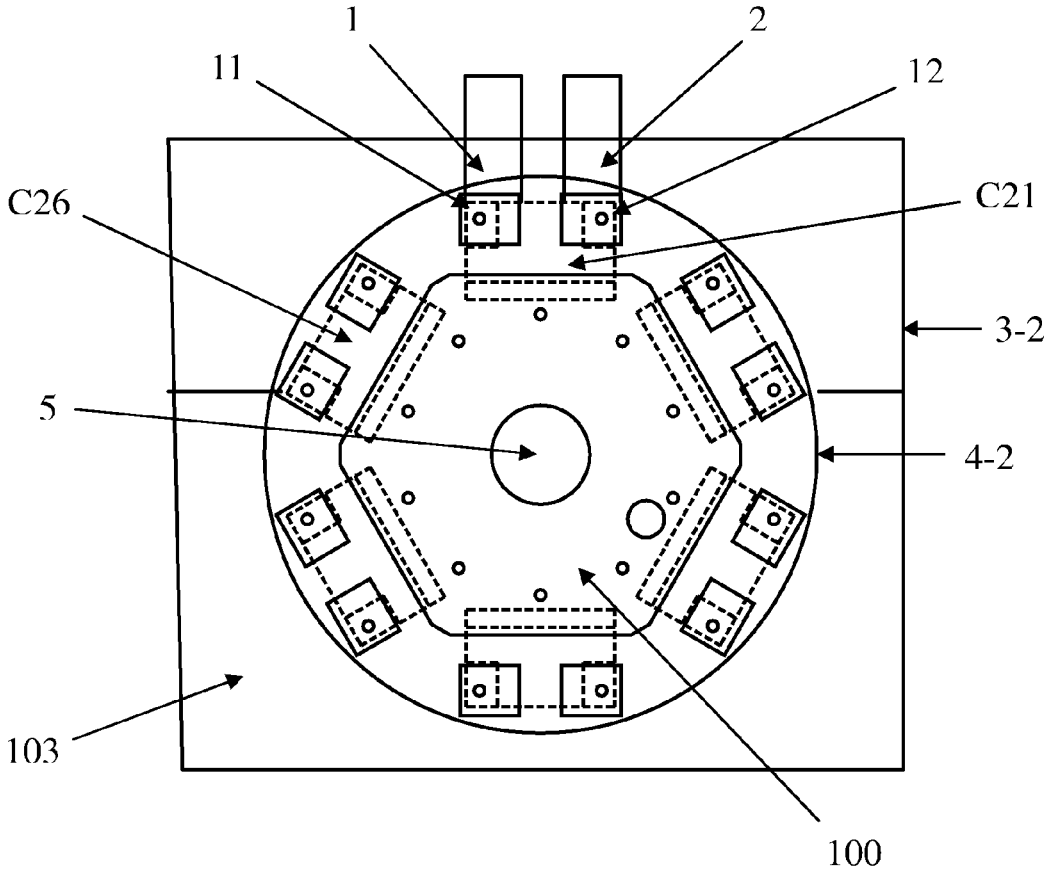
FIG. 14 illustrates a combination of a positioning body with a base of a device for adjusting an electric parameter of another exemplary embodiment of the invention.

As shown in FIG. 14, a combination of a positioning body with a base of a device for adjusting an electric parameter of a second embodiment of the invention is illustrated.

A surface layer of the positioning body 3-2 is contacted with a bottom layer of the base 4-2. The positioning hole 5*a* on the positioning body 3-2 is overlapped with the positioning hole 5 on the base 4-2. The terminal pair 11 and 12 on the base 4-2 is respectively connected to the signal terminals 1 and 2 on the positioning body 3-2. As the base 4-2 rotates, the next terminal pair on the base 4-2 is sequentially connected to the signal terminals 1 and 2 on the positioning body 3-2. For example, the terminal pair 21 and 22 is respectively connected to the signal terminals 1 and 2. The common ground terminal 100 of the base 4-2 is contacted with the ground terminal 103 of the positioning body 302.

As second portions with different electric parameters are used, adjustment of electric parameters is facilitated. It should be noted that, movement of the base 4-2 is not limited to rotation, and pushing can also be used to implement this. By changing input electric parameters between the signal terminals 1 and 2, adjustment of the electric parameters is facilitated. The shifting body 8 in this embodiment is the same as that in the first embodiment.

Figure 15:
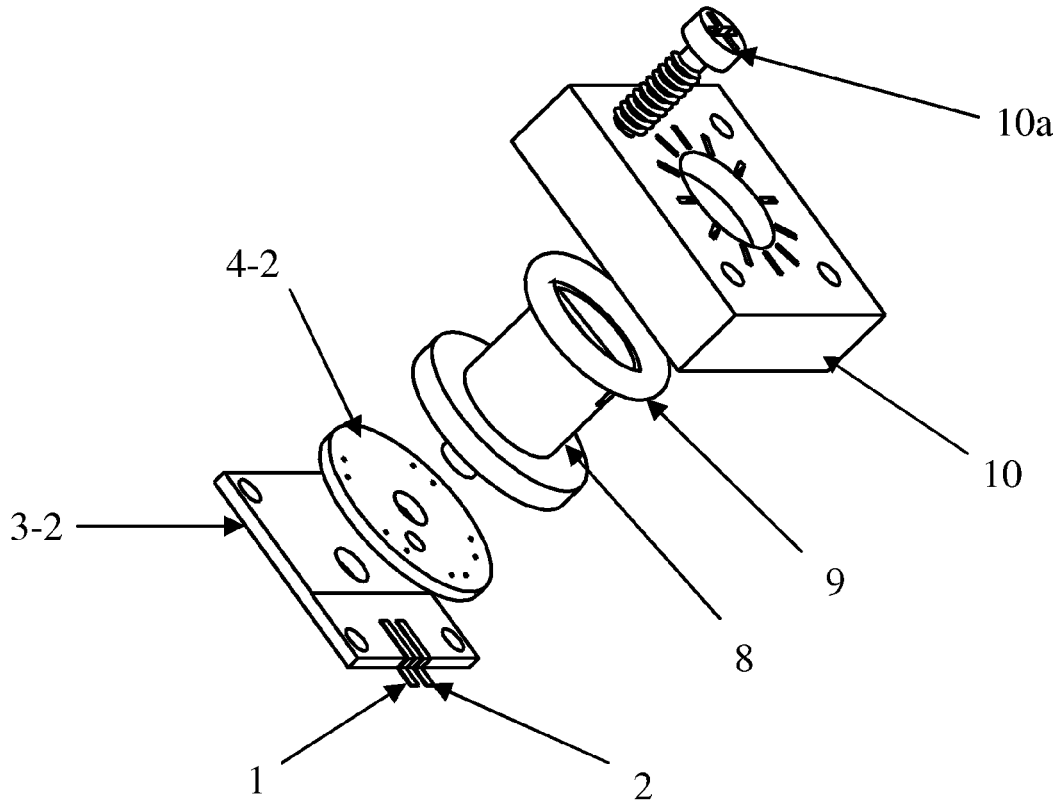
FIG. 15 is a schematic view of a device for adjusting an electric parameter of another exemplary embodiment of the invention.

As shown in FIG. 15, a device for adjusting an electric parameter of a second embodiment of the invention is illustrated. The base 4-2 is disposed on the positioning body 3-2. The bottom layer of the base 4-2 is contacted with the surface layer of the positioning body 3-2. The shifting body 8 is disposed on the base 4-2. An elastic body 9 is disposed on the shifting body 8, and between the pressure spanner 83 and a housing 10. An inner surface layer of the housing 10 is disposed on the elastic body 9. In this embodiment, the housing 10 is a resin housing, a metal housing, and so on.

The elastic body 9 is a silicon gel ring, a metal spring, or an elastic piece, and operates to tightly contact the base 4-2 with the positioning body 3-2 when fixing the positioning body 3-2 and the housing 10 via a screw 10*a* whereby tightly pressing the positioning body 3-2, the base 4-2, the shifting body 8, and the housing 10-2. The elastic body 9, the housing 10, and the screw 10*a* form a fastening device. It should be noted that other fastening components, such as bolts, buckles, and clamps, can also be used to fix the positioning body 3-2 and the housing 10 In addition, a fastening screw 10*a* disposed outside the housing 10 is used to fix the device for adjusting an electric parameter on an external circuit board.

It should be noted that, the base 4-2 and the shifting body 8 can be integrally formed whereby facilitating adjustment of electric parameters.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A device for adjusting an electric parameter, the device comprising:
- a base having at least two terminal pairs;
- a positioning body; and
- at least one first portion; wherein:
- both ends of at least one of said terminal pair are connected to said first portion;
- a pair of signal terminals are disposed on said positioning body;
- both ends of one of said terminal pairs are contacted with said signal terminals on said positioning body as a position of said base is changed;
- said first portion is an inductor, a capacitor, or a resistor; and
- said first portion is disposed on different layers or the same layer of said base.

2. The device of claim 1, further comprising a shifting body operating to rotate or to move said base thereby changing a position of said terminal pair on said base.

3. The device of claim 2, further comprising a fastening device operating to tightly contact said base with said positioning body.

4. The device of claim 3, wherein
- said fastening device comprises an elastic body, a housing, and a fastening portion;
- said fastening portion operates to fix said positioning body to said housing; and
- said elastic body is disposed on said shifting body, and between said shifting body and said housing.

5. The device of claim 4, wherein said elastic body is an elastic piece, a spring, or silica gel.

6. The device of claim 1, wherein said signal terminals on said positioning body extend to the bottom or the outside of said positioning body.

7. The device of claim 1, wherein said base is a PCB board, a ceramic substrate, or a resin base.

8. The device of claim 1, wherein said base is a single-layered substrate, a double-layered substrate, or a multi-layered substrate.

9. The device of claim 1, wherein one of said terminal pairs is short connected.

10. A device for adjusting an electric parameter, the device comprising:
- a base having at least two terminal pairs;
- a positioning body; and
- at least one first portion; wherein:
- both ends of at least one of said terminal pair are connected to said first portion;
- a pair of signal terminals are disposed on said positioning body;
- both ends of one of said terminal pairs are contacted with said signal terminals on said positioning body as a position of said base is changed; and
- one of said terminal pairs is short connected.

11. A device for adjusting an electric parameter, the device comprising:
- a base having at least two terminal pairs, and a common ground terminal;
- a positioning body having a ground terminal; and
- at least one second portion; wherein
- both ends of at least one of said terminal pair are connected to said second portion;

a pair of signal terminals and said ground terminal are disposed on said positioning body;

a ground terminal of said second portion on said base is connected to said common ground terminal;

said common ground terminal of said base is contacted with said ground terminal of said positioning body; and both ends of one of said terminal pairs are contacted with said signal terminals on said positioning body as a position of said base is changed.

12. The device of claim 11, further comprising a shifting body operating to rotate or to move said base thereby changing a position of said terminal pair on said base.

13. The device of claim 11, further comprising a fastening device operating to tightly contact said base with said positioning body.

14. The device of claim 13, wherein said fastening device comprises an elastic body, a housing, and a fastening portion;

said fastening portion operates to fix said positioning body to said housing; and said elastic body is disposed on said shifting body, and between said shifting body and said housing.

15. The device of claim 14, wherein said elastic body is an elastic piece, a spring, or silica gel.

16. The device of claim 11, wherein said signal terminals on said positioning body extend to the bottom or the outside of said positioning body.

17. The device of claim 11, wherein said base is a PCB board, a ceramic substrate, or a resin base.

18. The device of claim 11, wherein said base is a single-layered substrate, or a multi-layered substrate.

19. The device of claim 11, wherein said second portion is an attenuator, a filter, or an impedance transformer;

said second portion is disposed on different layers or the same layer of said base; and said second portion is disposed on said base via a thick-film process, or a thin-film process.

20. The device of claim 11, wherein one of said terminal pairs is short Connected.

* * * * *